United States Patent [19]

Wanlass

[11] Patent Number: 4,885,954

[45] Date of Patent: Dec. 12, 1989

[54] DOOR LOCK ACTUATOR

[76] Inventor: Bert R. Wanlass, 35 W. Valley Way, P.O. Box 206, Woodland Hills, Utah 84653

[21] Appl. No.: 130,715

[22] Filed: Dec. 9, 1987

[51] Int. Cl.[4] ..... E05C 3/06

[52] U.S. Cl. ..... 74/625; 292/201; 292/336.3; 403/69; 403/353

[58] Field of Search ..... 292/201, 336.3; 403/69, 403/70, 353, 375; 74/625, 405

[56] References Cited

U.S. PATENT DOCUMENTS

| | | | |
|---|---|---|---|
| 3,771,785 | 11/1973 | Speyer | 403/375 |
| 3,784,242 | 1/1974 | Hill | 292/336.3 |
| 4,093,289 | 6/1978 | Inabayashi et al. | 292/336.3 |
| 4,135,377 | 6/1979 | Kleefeldt et al. | 292/201 |
| 4,290,634 | 9/1981 | Gelhard | 292/336.3 |
| 4,478,445 | 10/1984 | Shimizu | 403/70 |
| 4,520,914 | 6/1985 | Kagiyama et al. | 74/625 |
| 4,566,576 | 1/1986 | Moriya et al. | 74/625 |
| 4,573,723 | 3/1986 | Morita et al. | 292/336.3 |
| 4,685,550 | 8/1987 | Metcalf | 192/67 R |
| 4,706,512 | 11/1987 | McKernon et al. | 292/336.3 |

FOREIGN PATENT DOCUMENTS

| | | | |
|---|---|---|---|
| 1336020 | 11/1973 | United Kingdom | 292/201 |

*Primary Examiner*—Leslie A. Braun
*Assistant Examiner*—Scott Anchell
*Attorney, Agent, or Firm*—Dykema Gossett

[57] ABSTRACT

The present invention relates to a power door lock actuator for use on a standard door lock system. The actuator operates quietly, has zero back drive and can be mounted on all vehicle types without retooling for each vehicle. The door lock has an arcuately mounted output arms, an attaching portion on the arm, a power source and a clutch to selectively couple the output arm and the motor.

12 Claims, 4 Drawing Sheets

10
12
14
18
20
22
24
26
28
30
34
38
40
42
44
46
48
49
50
52
54
56
58
60
62
64
66
68
70
71
72
74
76
78
80

DOOR LOCK ACTUATOR

BACKGROUND OF THE INVENTION

The present invention relates to a vehicle power door lock actuator. More particularly, the present invention relates to a power door lock actuator that operates quietly, has substantially zero back drive and can be mounted on all vehicle types without extra tooling for each type vehicle.

Standard door lock systems include a manual door lock button, a key entry, a locking mechanism and a connecting rod for interconnecting the button, key entry and locking mechanism. By manually pulling or pushing the locking button or operating the key entry, the door can be locked or unlocked.

Power door lock actuators of the general type do the pushing or pulling of the locking mechanism by the flip of a switch. Generally, the power actuator has an electric motor coupled to an output member that is connected to the door lock system. When the motor is energized, the output member is driven to automatically lock or unlock the door. An example of a common door lock actuator is disclosed in U.S. Pat. No. 3,954,016 of which the Applicant of the present invention was a co-inventor. The disclosed actuator has an output member 11 attached at one end to a manually-operated push button 28 with a rack section 100 at the other end connected to a motor 32 through a pinion gear 88. When motor 32 is energized at switch 90, the output member 11 extends or retracts in a linear path with respect to housing 31 to lock or unlock the door. A concentric guide roller 74 is provided to maintain proper alignment of the pinion gear 88 with respect to rack section 100.

Ideally, a power actuator should operate quietly and allow easy manual operation of the lock system. Although ideal, in actual practice quiet operation and easy manual operation are for the most part mutually exclusive. Quiet operation is obtained at the expense of manual operation, while easy manual operation is obtained at the expense of quiet operation.

A power actuator can be designed to operate quietly. This is typically accomplished by having a large gear ratio between the motor and output arm which slows down the movement of the system, thereby reducing noise. By slowing the speed of actuation, sudden impact of the door lock and actuator mechanisms are eliminated reducing noise and damage to the system. The disadvantage to using a large gear ratio is the resistance it gives to manual operation. This resistance to manual operation of tbe actuator is commonly referred to as "back-drive" which ideally should equal or at least closely approach zero. With zero back-drive, there is no resistance to manual operation of the door locks due to the actuator.

Back-drive can be reduced in the door lock actuator by using a small gear ratio or direct drive between the motor and the output arm. A disadvantage to this design is an increase in the speed of operation resulting in louder operation noises and damage to the system. Although back-drive is reduced, the actuator is louder. Another disadvantage is using smaller gear ratios or direct drive is the need for a larger motor to provide the necessary torque to operate the lock system. Larger motors weigh more, pull greater amperage, require larger, more costly wiring, necessitate the use of a relay and can encounter voltage drop problems.

The problem of back-drive is also related to magnetic cogging of the motor and the gear ratio of the actuator. Cogging is the resistance that is due to the magnetic flux of the electric motor resisting rotation of the rotor past the magnetic field. Cogging will vary with the size of the motor and its effect on manual operation will be amplified by the gear ratio used. With a smaller motor, the magnetic field is smaller; however, a larger gear ratio is needed to operate the system. The increased gear ratio increases resistance to manual operation because it effectively increases the cogging of the electric motor. A larger motor inherently has increased cogging and even though the cogging is not further amplified by the gear ratio, it contributes to back-drive.

SUMMARY OF THE INVENTION

Applicant's invention solves the above problems by providing a power actuator that has a small motor, zero back drive and operates slowly to reduce, if not eliminate, noise and the associated problems of wear and damage.

The door lock actuator of the present invention has an output member or output arm, a power means, preferably an electric motor, and a clutch for selectively coupling the arm to the motor. In the preferred embodiment, the output arm is attached to the connecting rod of the lock system and moves through an arcuate path between first and second positions that correspond to the locked and unlocked positions of the door-locking mechanism. Normally, the motor and output arm are disengaged by the clutching mechanism to allow easy manual operation of the door-locking system. When disengaged, there is zero back drive from the power actuator. To operate the power actuator, the electric motor is energized, and the clutching means engaged to couple the energized motor to the output arm to automatically lock or unlock the door.

The clutching means of the preferred embodiment has a clutch plate connected through a pinion gear to the output arm and a clutch case connected through a ring gear to the motor. The clutch plate and case are both rotatably mounted. Additionally, the clutch plate is mounted for axial movement for engagement with the clutch case. An electromagnet is mounted within the clutch case for magnetically drawing the clutch plate into engagement with the clutch case to couple the motor to the output arm. To facilitate coupling, the clutch plate has a number of teeth about its perimeter that engage within specially-formed spokes in the clutch case. A biasing means is positioned between the clutch plate and clutch case to urge them apart when the electromagnet is disengaged. In this way, the power actuator is normally disengaged from the door lock system so that manual operation is not resisted. When energized, the motor, through the ring gear, rotates the clutch case while the electromagnet pulls the clutch plate into engagement with the clutch case, thereby providing the power to move the output arm between the first and second positions.

Due to the clutching means, a large gear ratio and a small motor can be used without creating back-drive problems. In fact, the gear ratio can be substantially increased and the motor size substantially decreased. The increased gear ratio allows extremely slow operation resulting in virtually no noise from the locking system. In the preferred embodiment, the actuator takes approximately 300 milliseconds to lock or unlock the vehicle door while Applicant's prior actuator disclosed in U.S. Pat. No. 3,954,016 takes approximately 20 milliseconds. The present invention operates approximately 15 times slower than its predecessor. Further, the motor of the present invention is a micro-motor which is substantially smaller than conventional motors used in door lock actuators. For example, a typical motor used in door lock actuators may have a stall torque of approximately 10–14 in oz. while the present actuator uses a motor having a stall torque of approximately 0.8 in. oz. The micro-motor of the present invention has less power, therefore it can be a continuous duty motor obviating the need for a circuit breaker. Larger motors pull more amperage which causes the motors to heat rapidly necessitating the use of a circuit breaker. Additionally, smaller motors cost less, weigh less and have smaller wiring requirements.

A further advantage of the present invention is that the output arm can function as a moment arm to further amplify the output torque of the motor. The output arm has a fulcrum with a sector gear extending from one side and an attaching arm extending from the opposite side. By adjusting the length of the sector gear and attaching arm with respect to one another an amplification of the effective force at the working end of the output arm can be obtained.

A still further advantage of the present invention is the method of mounting the output arm to the lock system. The output arm has a mounting head which permits standardization of the power actuator for different vehicle types and eliminates the need for retooling each vehicle type. The mounting head has an axial bore extending through it with a slot intersecting the axial bore. To attach the actuator, the slot is coaxially aligned with the connecting rod, and the connecting rod is then inserted. Thereafter, the actuator is rotated to allow the connecting rod to enter the axial bore where it is retained. The actuator can then be bolted or otherwise mounted to the door. In the preferred embodiment, to facilitate mounting, the connecting rod has an offset portion for mounting purposes.

Other advantages and meritorious features of the present invention will be more fully understood from the following description of the invention, the appended claims, and the drawings, a brief description of which follows.

DETAILED DESCRIPTION OF THE INVENTION

Figures 1, 2:
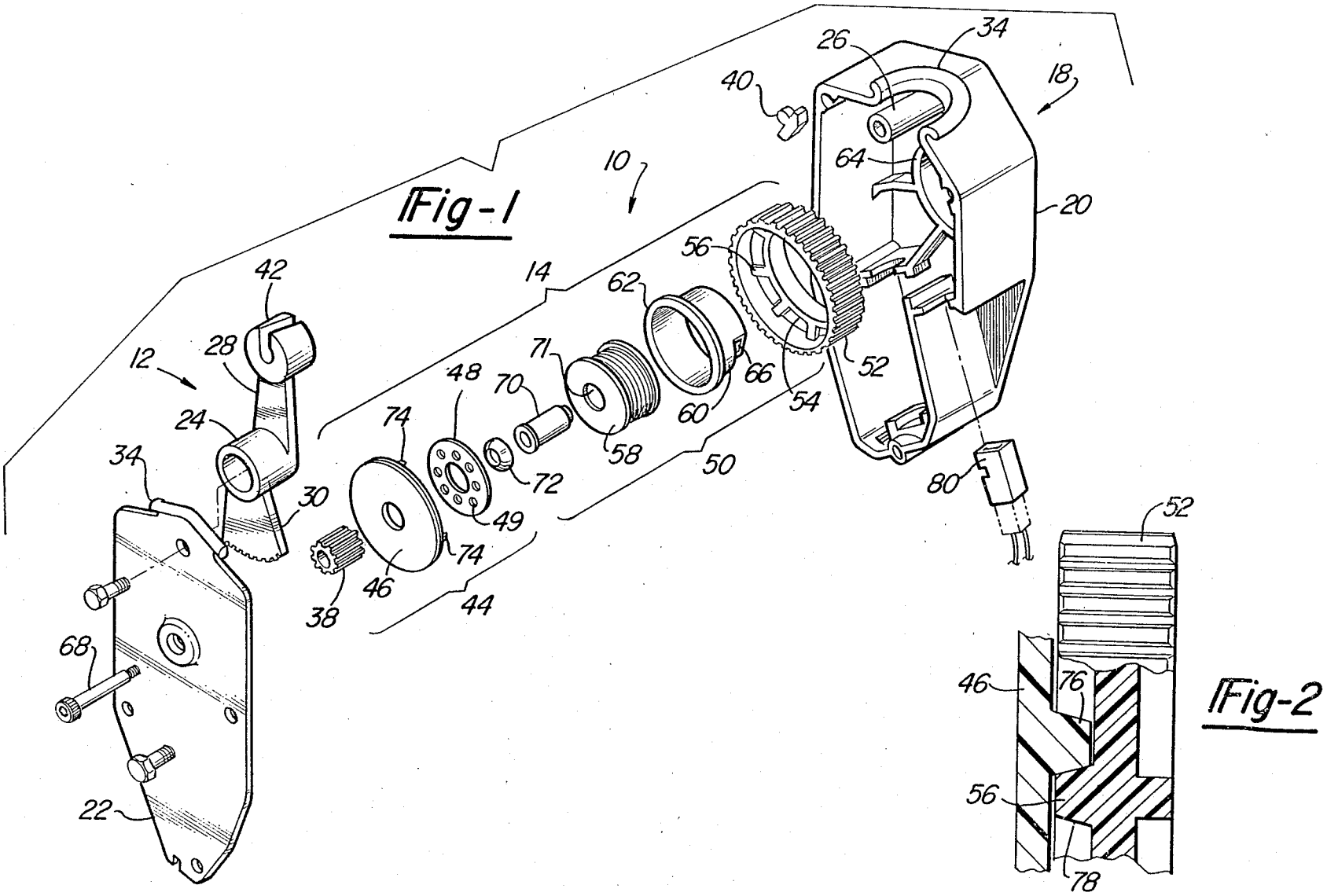
FIG. 1 is an exploded perspective view of the door lock actuator of the present invention.
FIG. 2 is a partial fragmentary view of the driven gear with the clutch plate engaged.
Figure 6:
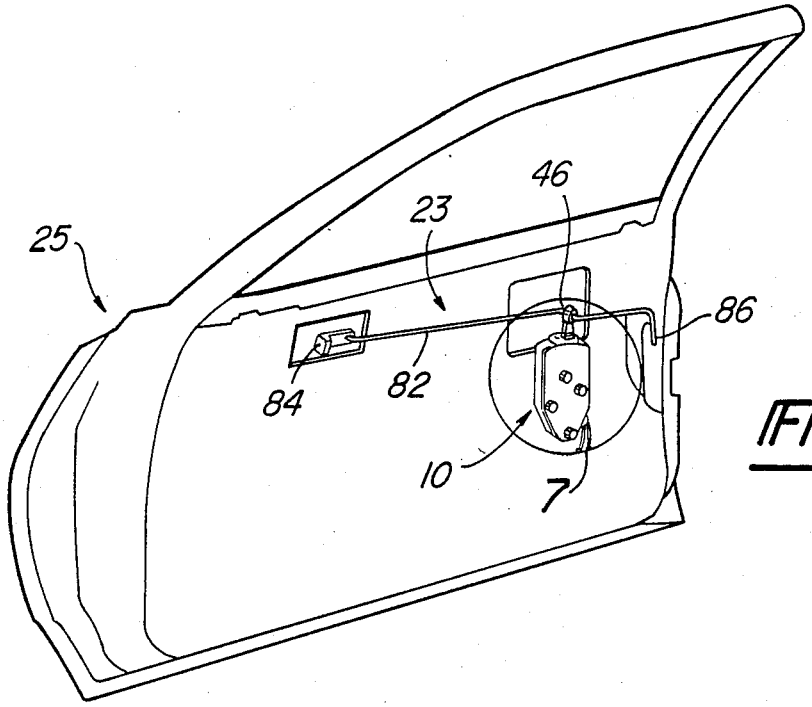
FIG. 6 is a perspective view of a typical vehicle door with the door lock actuator of the present invention mounted thereon.

With reference to FIG. 1, the door lock actuator of the present invention is shown generally at 10. Actuator 10 includes a housing 18 having a base 20 and cover plate 22 with an output arm 12, clutching assembly 14 and power means 16, preferably an electric motor, mounted inside (see FIG. 3). With reference to FIG. 6, the power actuator 10 is shown mounted to a door-locking system 23 of a typical vehicle door 25. The manner in which power actuator 10 is mounted will be discussed in greater detail below.

Figure 4:
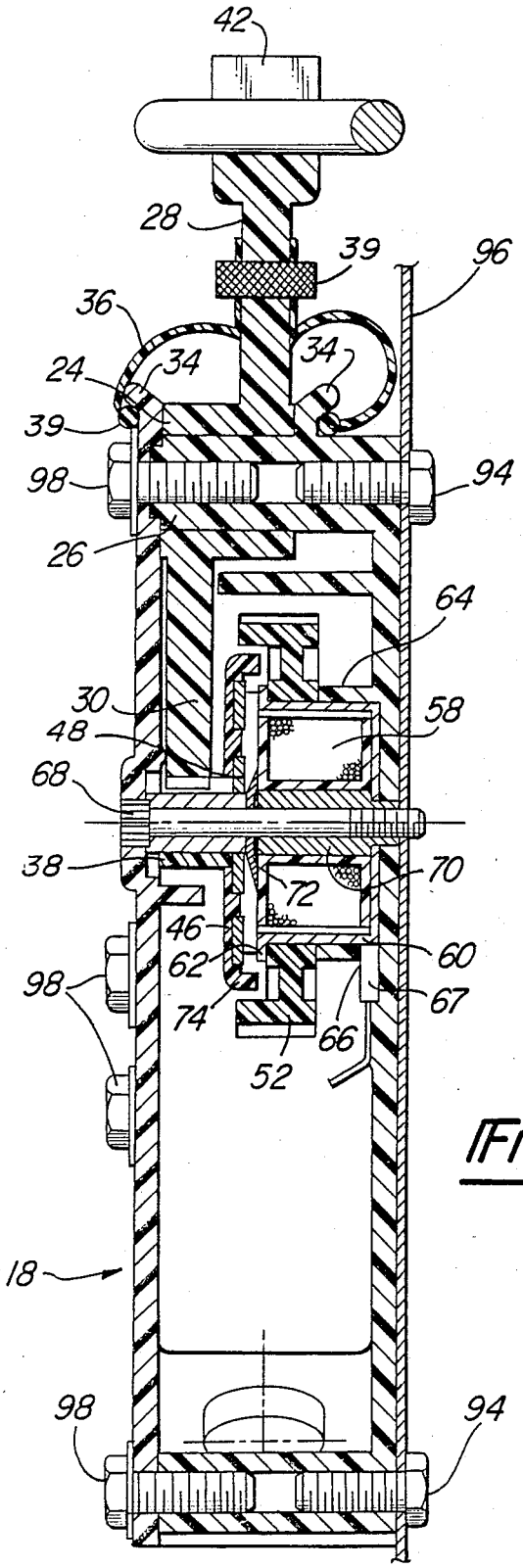
FIG. 4 is a cross-sectional side view of the door lock actuator of the present invention.

In the preferred embodiment, output arm 12 of actuator 10 is mounted for arcuate movement within housing 18. Arm 12 includes a hub 24, attaching arm 28 and a sector gear 30. Hub 24 is rotatably mounted upon a boss 26 which protrudes from base 20 and is maintained axially upon boss 26 by mounting ears 34 which extend from base 20 and cover plate 22, see FIGS. 1 and 4. As shown in FIGS. 1 and 4, attaching arm 28 extends from one side of hub 20 for attaching the actuator 10 to the locking system 23 and sector gear 30 extends from the other side of hub 24 for coupling actuator 10 to a pinion gear 38 which forms part of the clutching mechanism 14.

Figure 3:
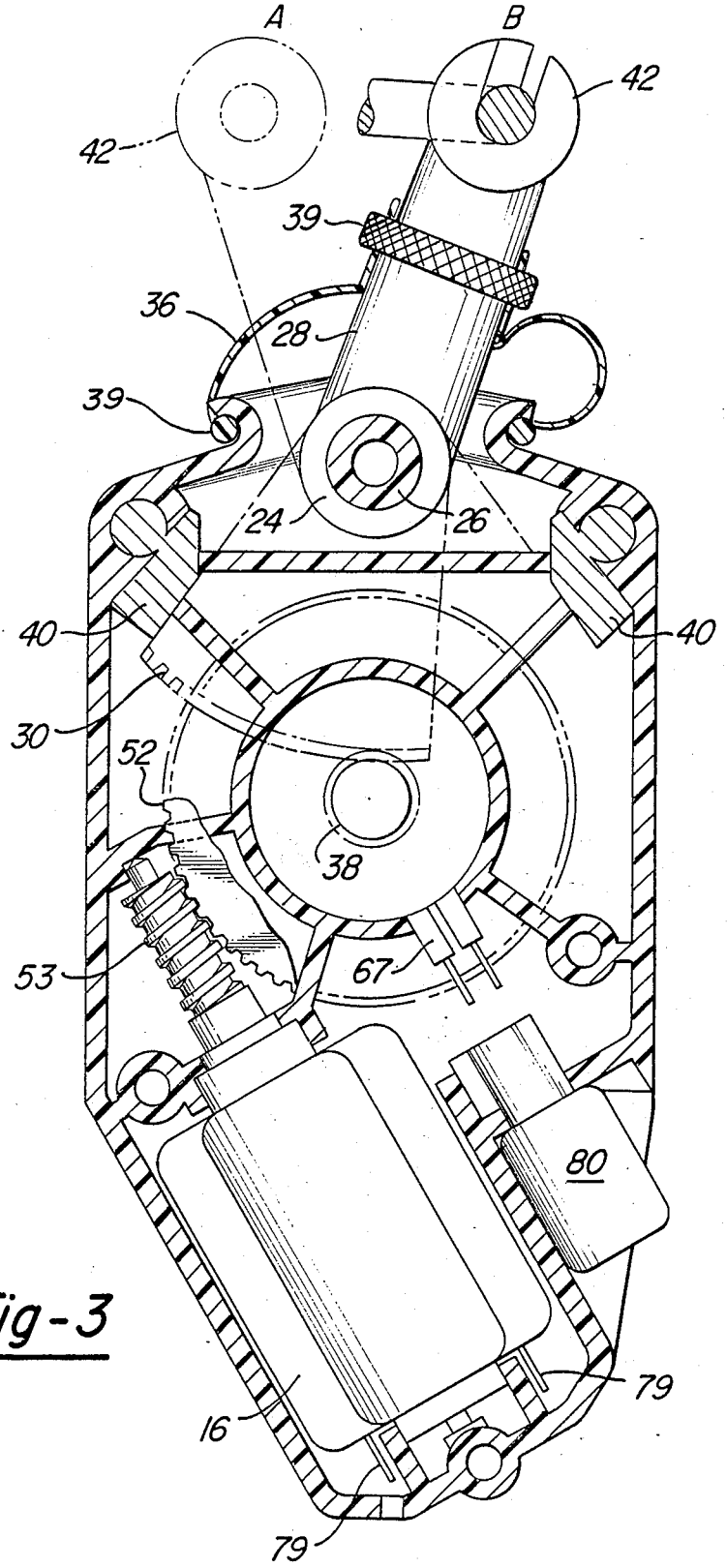
FIG. 3 is a cross-sectional plan view of the door lock actuator of the present invention.

With reference to FIG. 3, the arcuate movement of output arm 12 is illustrated. As shown, arm 12 rotates between a first position A and a second position B which correspond to the locked and unlocked positions of locking system 23. Rubber stops 40 are provided to cushion the end of travel of arm 12 to reduce noise and damage to the actuator and locking system. A rubber boot 36 is provided to enclose the actuator housing 18 to prevent contaminants from entering the interior of housing 18. Boot 36 has bands 39 to attach it to mounting ears 34 and attaching arm 28.

The arcuately mounted output arm 12 of the present invention permits travel of arm 12 to be changed and the output force of actuator 10 to be varied. By changing the length of output arm 12, actuator 10 can be modified for different applications of travel and output force. For example, in the preferred embodiment at 0.8 inches of travel, actuator 10 will generate approximately seven pounds of force. If the actuator travel is reduced to 0.4 inches, preferably by shortening the length of the output arm 28, the actuator will provide 14 pounds of output force. At a travel of 1.6 inches, the output force is 3.5 pounds. In this way, the actuator can be readily changed for universal adaptation to many different applications.

Additionally, the output member 12 of the present invention can function as a simple lever arm with the hub 24 being the fulcrum. This would be accomplished by adjusting the length of arm 28 with respect to the radial length of sector gear 30. The applied torque acting through pinion gear 38 is transferred to sector gear 30 with an amplification of the effective force at attaching head 42. Since the effective force is amplified, less torque must be applied at sector gear 30, allowing a smaller motor to be used. The advantage of the output arm acting as a lever arm becomes more apparent when the present actuator is compared to common actuators such as the actuator disclosed in U.S. Pat. No. 3,954,016 (hereinafter referred to as the '016 actuator). Output member 11 of the '016 actuator moves in a linear path. The force necessary to move output member 11 must be produced at the pinion gear 88 without the benefit of amplification. Thus, the '016 actuator requires more torque at the pinion gear to move the output member than would be required by actuator 10 of the present invention acting as a simple lever. In this way, the present actuator can use a smaller power means or motor because the torque necessary to produce enough force to move the output member is less.

With reference to FIG. 1, the clutching assembly 14 of the preferred embodiment will be described. Assembly 14 has a clutch plate, shown generally at 44, and a clutch case, shown generally at 50 with both mounted in axial alignment on shaft 68. Plate 44 is mounted upon shaft 68, for both rotational and axial movement. A biasing means 72, which in the preferred embodiment is a warp spring, normally separates plate 44 and case 50. Clutch plate 44 includes pinion gear 38, an engaging disc 46, and a ring 48. In the preferred embodiment, pinion gear 38 is press-fit or otherwise affixed to one side of disc 46, and ring 48 is affixed to the opposite side. The axial length of pinion gear 38 is long enough to maintain continued contact with sector gear 30 throughout the extent of axial movement of plate 44. Clutch case 50 includes a driven gear 52 which includes an inner hub 54 connected to the interior of gear 52 by a plurality of equally-spaced spokes 56. An electromagnet 58 is mounted within hub 54.

In the preferred embodiment, engaging disc 46 is formed of plastic or nylon to reduce actuation noise. To obtain the necessary magnetic flux needed to engage clutch plate 44 with clutch case 50, as will be described more fully below, ring 48 is formed of ferris metal. Preferably, ring 48 has a series of holes 49 to facilitate bonding to plate 44. Pinion gear 38 is preferably made of aluminum and has a diametral pitch of 32.

With reference to FIG. 4, hub 54 is rotatably mounted upon the outer surface of electromagnet housing 60. The inner surface of hub 54 and outer surface of housing 60 are smooth to provide cooperating bearing surfaces for free rotation of gear 52. A lip portion 62 on housing 60 cooperates with boss 64 of base 20 to retain driven gear 52 in its proper position. Electromagnet 58 is mounted within housing 60 which has an opening 66 for receipt of the electromagnet leads 67. A spacer 70 is inserted into opening 71 of magnet 58 to retain electromagnet 58 on shaft 68. Shaft 68 is adapted to be threaded into base 20 to secure the clutch assembly and to function as a shaft on which clutch plate 44 is rotatably and axially mounted.

In the preferred embodiment, driven gear 52 is made of nylon to reduce noise and has a diametral pitch of 48. Worm gear 53, in the preferred embodiment, is a double start worm gear and has a diametral pitch of 48. Coupling worm gear 53 with gear 52 provides a gear ratio of 32:1 which is extremely high when compared to standard door lock actuators. Due to this ratio, the door lock actuator operates very slowly reducing if not eliminating noise and damage and permits a much smaller motor to be used. However, this extremely high gear ratio does not effect back-drive because the output arm 12 is normally disengaged from gear 52 and motor 16 when the actuator 10 is not energized.

In operation, the electric motor 16 is energized, which causes driven gear 52 to rotate through the rotation of worm gear 53. Simultaneously, the electromagnet 58 is energized, which magnetically draws the clutch plate 42 into engagement with electromagnet 58 against the bias of biasing means 72. To facilitate the clutching action of clutch 44, teeth 74 are provided on clutch plate 44 to engage spokes 56 of driven gear 52. Teeth 74 extend outwardly about the perimeter of disc 46 in the direction of spokes 56. With reference to FIG. 2, the clutch teeth 74 and spokes 56 are shown having beveled surfaces 76 and 78 respectively which facilitate the interengagement of the teeth 74 with the spokes 56 and reduce noise.

The electrical leads 67 and 79 of electromagnet 58 and motor 16 are received within a two-place electrical connector 80. In the preferred embodiment, the total amperage draw is approximately equal to the amperage draw of motor 16 which is two amps. The typical amperage draw for door lock actuators is approximately 30 amps. Because of the low amperage draw of the present invention, the elimination of relays becomes practical with the operation of the motor through transistors being practical and preferred. Further, the lower amperage reduces the system's wire size, cost and overall weight.

Figure 5:
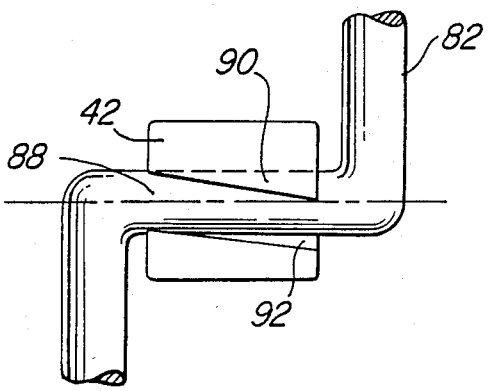
FIG. 5 is a view of the mounting head and connecting rod of the present invention.
Figure 7:
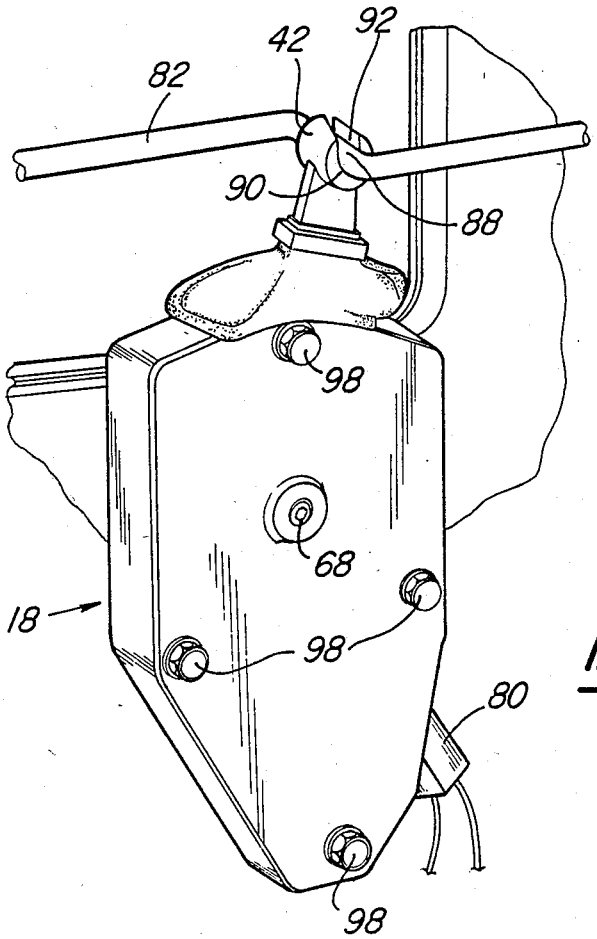
FIG. 7 is a perspective view of the door lock actuator of the present invention mounted upon the connecting rod.

With reference to FIGS. 5, 6 and 7, the attaching head 42 and method of mounting the door lock actuator 10 of the present invention will be described. The locking system 23 of a typical vehicle door 25 is illustrated in FIG. 6 for purposes of explanation only. Other door locking systems are known, and actuator 10 of the present invention is intended for use on all systems. The illustrated system 23 includes a connecting arm 82 interconnecting a manual locking button 84 with a locking mechanism 86. The manual locking button may be pushed or pulled to lock or unlock the door.

The actuator 10 of the present invention has a mounting head 46 for attachment to the connecting arm 82. To standardize the actuator for use on any vehicle type, the control arm is preferably provided with an offset portion 88, see FIG. 7. The attaching head 47 has an axially-extending bore 90 with an intersecting slot 92 which intersects at an acute angle to axial bore 90. To mount actuator 10, the offset portion 88 is inserted into slot 92, then the actuator is rotated so that offset portion 88 is received within axial bore 90. Thereafter, bolts 94 are threaded through mounting panel 96 to retain actuator 10. Additional bolts 98 are used to mount cover plate 22 to housing 18. As is apparent, actuator 10 has an insensitive mounting position allowing it to be mounted in any orientation with respect to offset 88. The direct attachment of actuator 10 to the control rod eliminates remote mounting components and related costs in tooling and eliminates the extra tooling required for car-to-car applications. In this manner, the mounting of actuator 10 can be standardized by merely offsetting the connecting arm 80 for receipt of attaching head 42.

The operation of actuator 10 will now be described. It is important in any vehicle having a power door lock actuator to also have the capability of easy manual or key operation of the lock system. Actuator 10 of the present invention is normally disengaged from the motor 16 so that there is no back drive. The clutch plate 44 is normally separated from clutch case 50 by biasing means 72. In the normal condition, manual button 84 or a key lock (not shown) can be easily manipulated because there is no back drive from actuator 10. To operate actuator 10, a switch or button located inside the passenger compartment is actuated which energizes motor 16 and electromagnet 58 through electrical connector 80. Motor 16 through worm gear 53 drives driven gear 52 while the electromagnet 58 pulls teeth 74 into engagement with spokes 56. Upon engagement, clutch plate 44 rotates upon shaft 68 at the same speed as driven gear 52. This rotation is applied as a torque to the sector gear 30 of output arm 12 through pinion gear 38 causing arm 12 to rotate upon boss 26. The arcuate travel of output arm 12 is controlled by rubber stops which also reduce noise in the system. In this manner, a power door lock actuator is provided which has zero back drive slow operation and has substantially noiseless operation.

It should be understood that the preferred embodiment of the present invention has been described as a single unit including each of the features discussed. However, it is within the intended scope of the invention that each feature or a combination of features may be used separately. For example, the clutching assembly 14 and power means 16 may be used with an output arm which moves linearly instead of arcuately. Furthermore, the arcuately mounted output arm 12 may be used with conventional types of power means without the clutching assembly. Still further, the clutching assembly may include other mechanisms to disengage the power means from the output arm.

It will be apparent to those skilled in the art that the foregoing disclosure is exemplary in nature rather than limiting, the invention being limited only by the appended claims.

What is claimed is:

1. A door lock actuator for use on a vehicle having a door lock system which includes a manual lock means, a locking mechanism and a connecting rod, said acutator comprising:

an output member movable between first and second positions corresponding to the locked and unlocked positions of said door lock mechanism, said output member having first and second ends;

power means for driving said output member between said first and second positions, said power means being operatively coupled to one end of said output member; and attaching means at said opposite end of said output member for attaching said output member to said connecting member, said attaching means including a bore extending through said output member and a slot intersecting said bore at an acute angle to the center line of said bore, said slot being adapted to receive said connecting rod, thereafter said bore being adapted to receive said rod upon rotation of said actuator to thereby retain said connecting rod within said output member.

2. The actuator of claim 1, wherein said connecting rod is offset for receipt of said output member.

3. The actuator of claim 1, wherein said output member is mounted for arcuate movement about a pivot point positioned along said output member between said ends of said output member.

4. The actuator of claim 1, further comprising a clutch means positioned between said output member and said power means to selectively engage and disengage said power means from said output member.

5. A door lock actuator for use in a vehicle having a door lock, a manual lock control and a connecting arm interconnecting the door lock and the manual lock control so that upon manual operation of said manual lock control, said door lock is locked and unlocked, said actuator comprising:

a housing;

a power means;

an output member pivotally mounted to said housing, said output member having first and second ends with said first end being adapted for connection to said connecting arm and said second end having a first gear means thereon;

a clutch means having a clutch plate formed of non-magnetic material having first and second sides and a second gear means, said second gear means extending outwardly from said first side of said clutch plate for coupling said clutch means to said first gear means of said output member;

said second side of said clutch plate having a magnetic means thereon, said clutch means being slidable with respect to said output member;

a worm gear connected to said power means;

a driven gear formed of non-magnetic material operatively coupled to said worm gear and being driven thereby, said driven gear having an open central portion facing said clutch plate for receipt of an electro-magnet;

an electro-magnet mounted within said central portion of said driven gear;

said driven gear and said clutch means being coaxially mounted, said clutch plate being magnetically drawn to said driven gear upon actuation of said electro-magnet to couple said output member to said power means upon actuation of said door lock actuator.

6. The door lock actuator of claim 5, wherein said first end of said output member includes a mounting head having a longitudinal bore extending therethrough and a slot intersecting said longitudinal bore at an angle thereto such that said attaching means is mountable to said control arm by first inserting said control arm into said slot then rotating said actuator so that said control arm is received and retained within said longitudinal bore.

7. The door lock actuator of claim 6, wherein said connecting arm has an offset portion for receipt of said attaching means.

8. The actuator of claim 5, wherein said first gear means is a sector gear and said second gear means is a pinion gear in operable engagement with said sector gear.

9. The actuator of claim 5, wherein said driven gear includes an inner hub mounted for concentric rotation with respect to said clutch means and a plurality of spokes interconnecting said hub with said driven gear;

said clutch plate including a plurality of teeth engageable within said spokes upon axial movement of said clutch plate.

10. The actuator of claim 9, wherein said teeth and spokes are beveled to facilitate interengagement.

11. The actuator of claim 5, further including a biasing means positioned between said driven gear and said clutch plate.

12. The actuator of claim 11, further comprising a magnetically actuable clutching means, said clutching means normally disengaging said power means from said output member to permit free operation of said manual lock means, said clutching means engaging said power means with said output member when said actuator is energized to power said output member between said locked and unlocked positions.

* * * * *